US005964666A

United States Patent [19]

Uemura

[11] Patent Number: 5,964,666

[45] Date of Patent: Oct. 12, 1999

[54] FALLING AMUSEMENT RIDE

[75] Inventor: Hiroshi Uemura, Tokyo, Japan

[73] Assignee: SEGA Enterprises, Ltd., Tokyo, Japan

[21] Appl. No.: 09/011,530

[22] PCT Filed: Jun. 19, 1997

[86] PCT No.: PCT/JP97/02112

§ 371 Date: Apr. 3, 1998

§ 102(e) Date: Apr. 3, 1998

[87] PCT Pub. No.: WO98/00212

PCT Pub. Date: Jan. 8, 1998

[51] Int. Cl.[6] ..... A63G 31/10

[52] U.S. Cl. ..... 472/50; 472/2; 472/61

[58] Field of Search ..... 472/2, 49, 50, 472/59, 60, 131, 136, 61; 434/29, 55

[56] References Cited

U.S. PATENT DOCUMENTS

| | | | |
|---|---|---|---|
| 5,004,225 | 4/1991 | Krukovsky | 472/61 |
| 5,417,615 | 5/1995 | Beard | 472/50 |
| 5,447,211 | 9/1995 | Sors | 472/131 X |
| 5,597,358 | 1/1997 | Marcu | 472/50 |
| 5,632,686 | 5/1997 | Checketts | 472/131 |

FOREIGN PATENT DOCUMENTS

| | | |
|---|---|---|
| 35-31535 | 11/1960 | Japan . |
| 4-309395 | 10/1992 | Japan . |

*Primary Examiner*—Kien T. Nguyen

*Attorney, Agent, or Firm*—Dickstein Shapiro Morin & Oshinsky LLP

[57] ABSTRACT

A falling amusement ride which is capable of letting a player enjoy a thrill of dropping to the same extent as in a conventional equipment in spite of its height restrained low is provided. The falling amusement ride has a seat supported so as to go up and down to be dropped, and illusion giving device for giving an illusion regarding a sense of height to the player sitting on the seat.

9 Claims, 7 Drawing Sheets

FALLING AMUSEMENT RIDE

TECHNICAL FIELD

The present invention relates to a falling amusement ride for letting a player enjoy a thrill by lifting up and then dropping freely the player sitting on a seat.

BACKGROUND ART

In the above-mentioned falling amusement ride, as the position where the falling starts is higher, the player is frightened and excited more.

Therefore, hitherto, a considerably high support or tower has been erected so that the player is lifted to a considerable height actually. And since the support or tower is built rising to the sky in a broad open air, the place for constructing the ride is limited naturally. Especially, it is almost impossible to construct the ride within doors, and therefore the number of actually constructed rides was few.

DISCLOSURE OF INVENTION

The present invention has been accomplished in view of the foregoing and it is an object of the invention to provide a falling amusement ride which is capable of letting a player enjoy a thrill of falling to the same extent as in a conventional ride in spite of its height restrained low.

In order to attain the above object, the present invention provides falling amusement ride in which a seat supported so as to go up and down is dropped, having illusion giving means for giving an illusion regarding a sense of height to a player sitting on the seat.

Since the illusion giving means gives an illusion regarding a sense of height to a player sitting on the seat, the player feels as if he were falling from a considerably high position in spite of that the ride itself is low and can enjoy a thrill of falling to the same extent as in a conventional ride.

Therefore, places for constructing the ride are limited little and it can be intended to increase the number of constructed rides.

The above illusion giving means may comprise a number of lighting devices arranged in a vertical direction in front of the seat going up and down, and turning on and off control means for letting the lighting devices turn on and off in order in one direction.

When the lighting devices arranged in a vertical direction are turned on and off in order from top to bottom, the player sitting on the seat and watching the turning on and off of the lighting devices feels illusively as if he were going up though he stops in position actually. On the other hand, when the lighting devices are turned on and off in order from bottom to top, the player feels as if he were going down though he stops in position actually.

The above turning on and off control means may let the lighting devices turn on and off in order concurrently with and in the opposite direction to the seat going up and down. If the lighting devices are turned on and off in order from top to bottom when the player is going up actually together with the seat, he feels illusively as if the rising speed were faster than the actual speed. On the other hand, if the lighting devices are turned on and off from bottom to up in order when the player is going down actually, he feels as if the falling speed were faster than the actual speed.

Or the above illusion giving means may comprise a moving body capable of moving up and down in front of the seat going up and down, and driving control means for moving he moving body in a direction. When the driving control means moves the moving body downward, the player sitting on the seat and watching the moving body going down before his eyes feels illusively as if he were going up though he stops in position actually. On the other hand, when the moving body is moved upward, the player feels illusively as if he were going down though he stops in position actually.

The above driving control means may move the moving body concurrently with and in the opposite direction to the seat going up and down. If the moving body is moved downward when the player is going up actually together with the seat, he feels illusively as if the rising speed were faster than the actual speed. On the other hand, if the moving body is moved upward when the player is going down actually, he feels illusively as if the falling speed were faster than the actual speed.

Further, the above illusion giving means may comprise side walls isolating a space which the seat goes up and down within from the outside, and a window formed in one of the side walls in front of the seat at a position of predetermined height, the window being constituted so as to limit sight of a player sitting on the seat to hide a part of lower outside from the player.

The player sitting on the seat is lifted within the space isolated from the outside in a state that it is difficult to obtain an exact height sense, and then sees the outside through the window formed at a predetermined height and constituted so as to limit sight of the player to hide a part of lower outside. Therefore, the player feels illusively as if he were at a considerably high position.

The aforementioned falling amusement ride may have a tower forming a space which the seat goes up and down within erected in a building and a top part of the tower hidden by a ceiling of the building.

When the player looks up the tower before he gets in the falling amusement ride, he has an illusion that the tower pierces through the ceiling and rises high because a top of the tower is hidden by the ceiling and cannot be seen, and then he gets in the ride, sits on the seat and is lifted with the illusion so that he feels as if he were lifted to a considerably high place though he is not lifted so high actually.

THE BEST MODE FOR CARRYING OUT THE INVENTION

Hereinafter, a preferred embodiment of the present invention will be described with reference to FIGS. 1 to 7.

Figure 1:
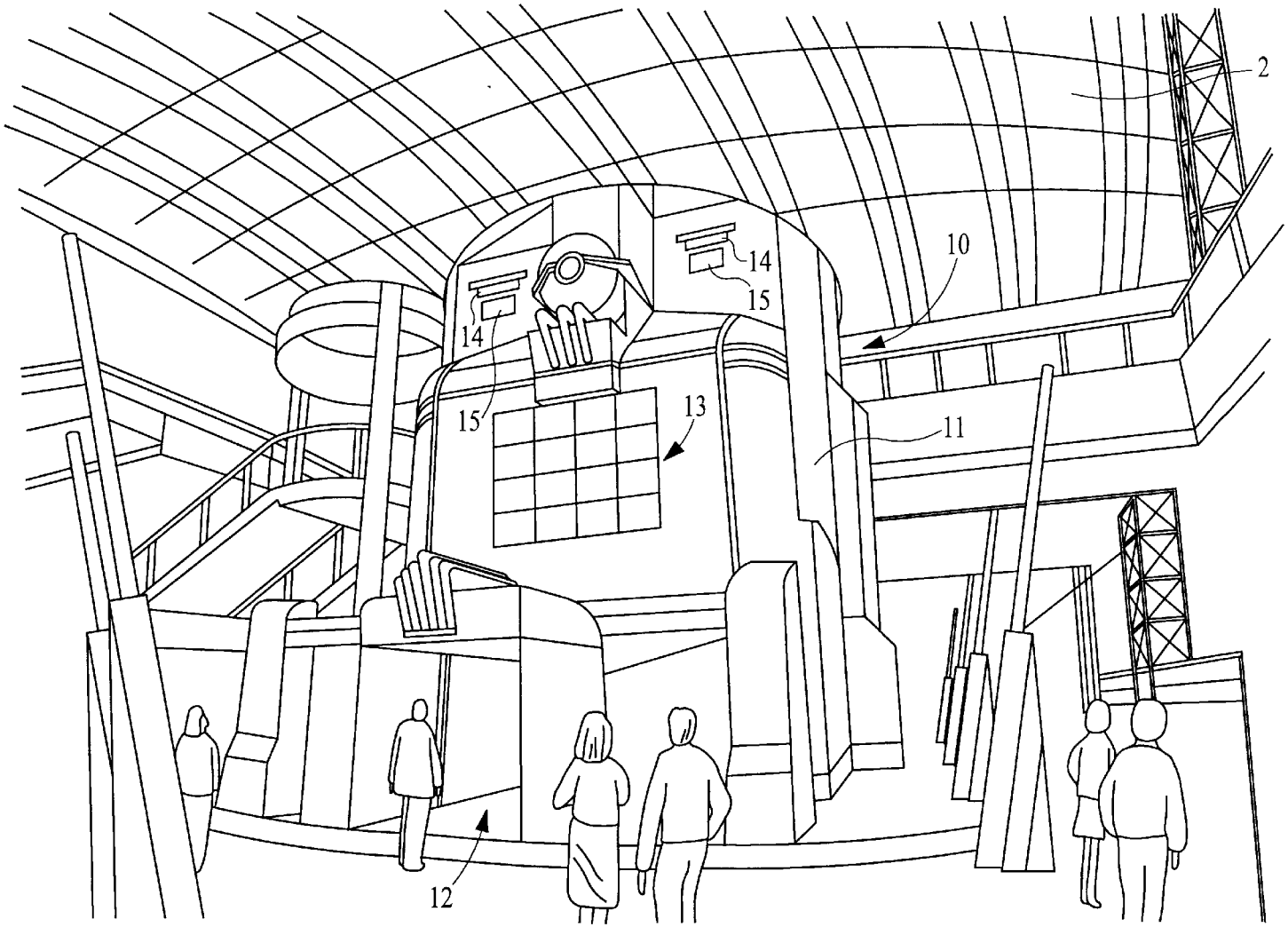
FIG. 1 is an external view of a falling amusement ride according to a preferred embodiment of the present invention as viewed from inner side of a building.

FIG. 1 is an external view of a falling amusement ride 10 according to the preferred embodiment. The dropping amusement equipment 10 is provided within a building 1 and constitutes a tower 11 in appearance.

The building 1 is covered by a dome-like roof 2. As shown in FIG. 1, when the tower 11 is seen from the interior of the building 1, the tower 11 appears to pierce through the roof 2 so as to hide a top thereof. Therefore, a person looking up the tower 11 has an illusion that the tower 11 pierces through the roof 2 and rises high, though actually the tower 11 is barely higher than the roof 2.

A ground floor of the tower 11 is projected toward the front and entrances 12, 12 are arranged right and left at the front thereof. On a front face of the tower 11 above the ground floor are arranged a multi-monitor 13 and further above it are provided right and left windows 15, 15 having respective shutters 14, 14.

Figure 2:
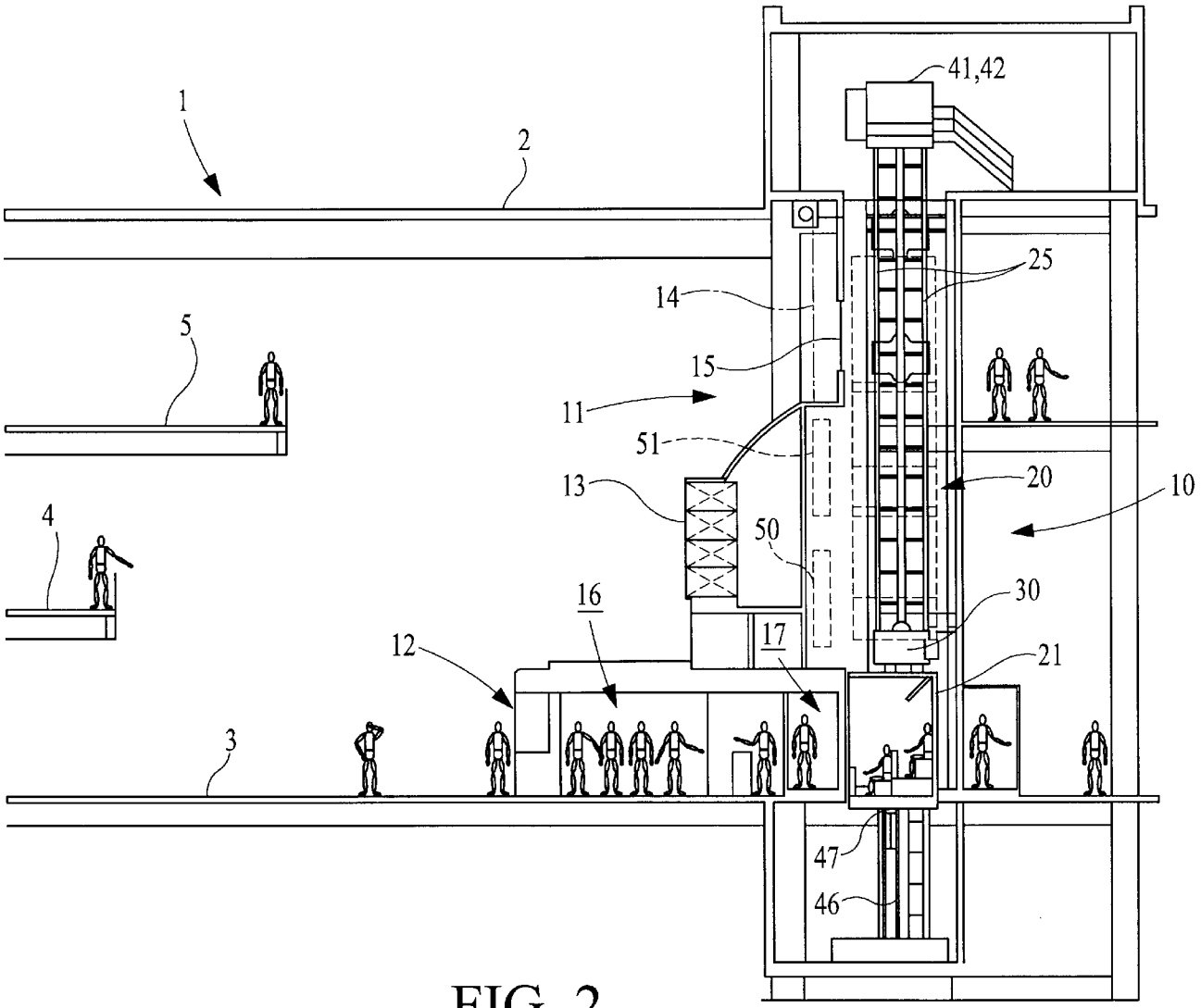
FIG. 2 is a sectional view showing interiors of the building and the falling amusement ride.

As shown in FIG. 2, the tower 11 is erected on a first floor 3 of the building 1 which has a second floor 4 and a third floor 5 projected toward the front of the tower 11 as porches.

Players P participating in the falling amusement enter in the falling amusement ride 10 through one of the entrances 12 looking up the tower 11 with the illusion that the tower is very high, as mentioned above.

Figure 3:
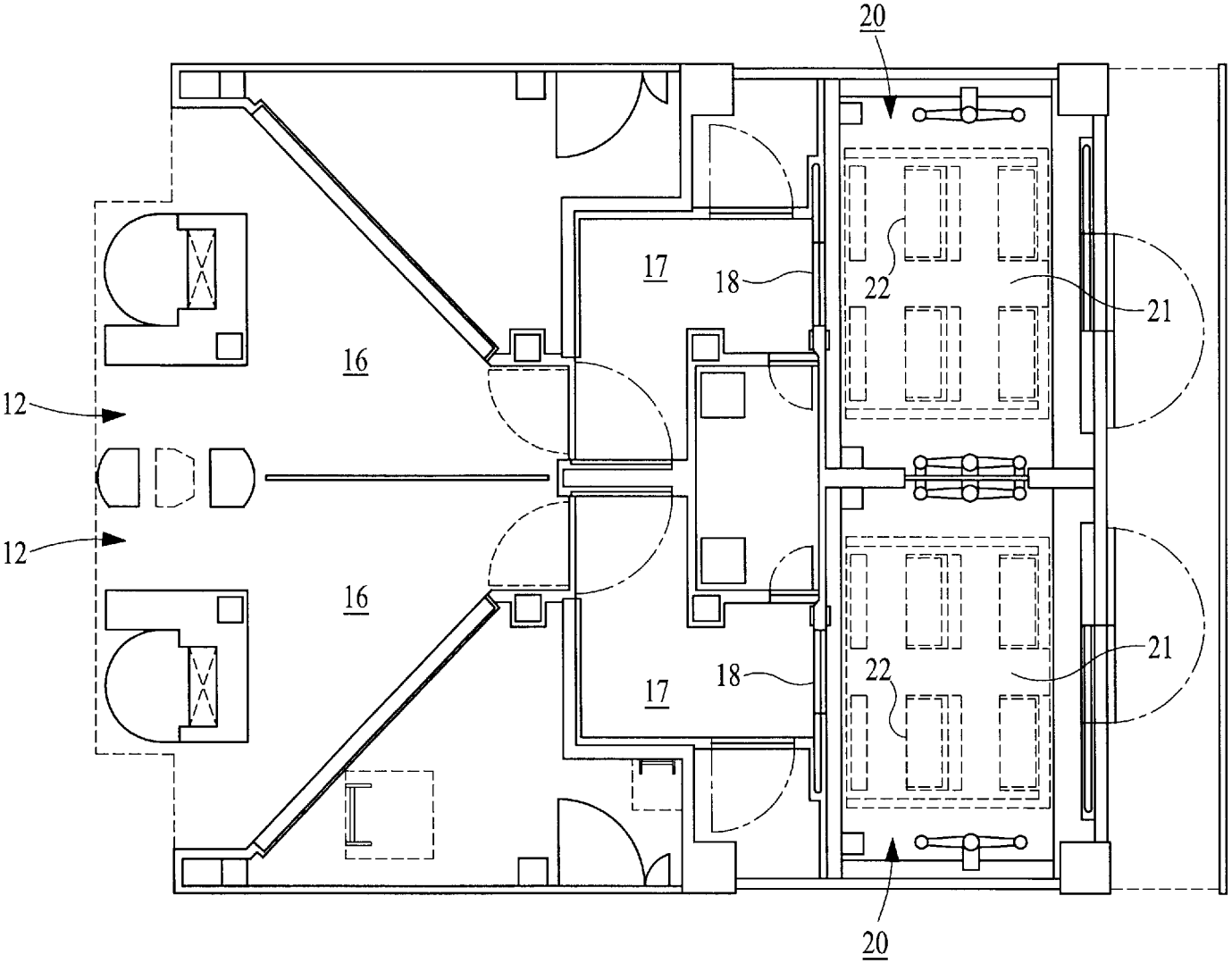
FIG. 3 is a plan view of a ground floor of a tower of the falling amusement ride.
Figure 4:
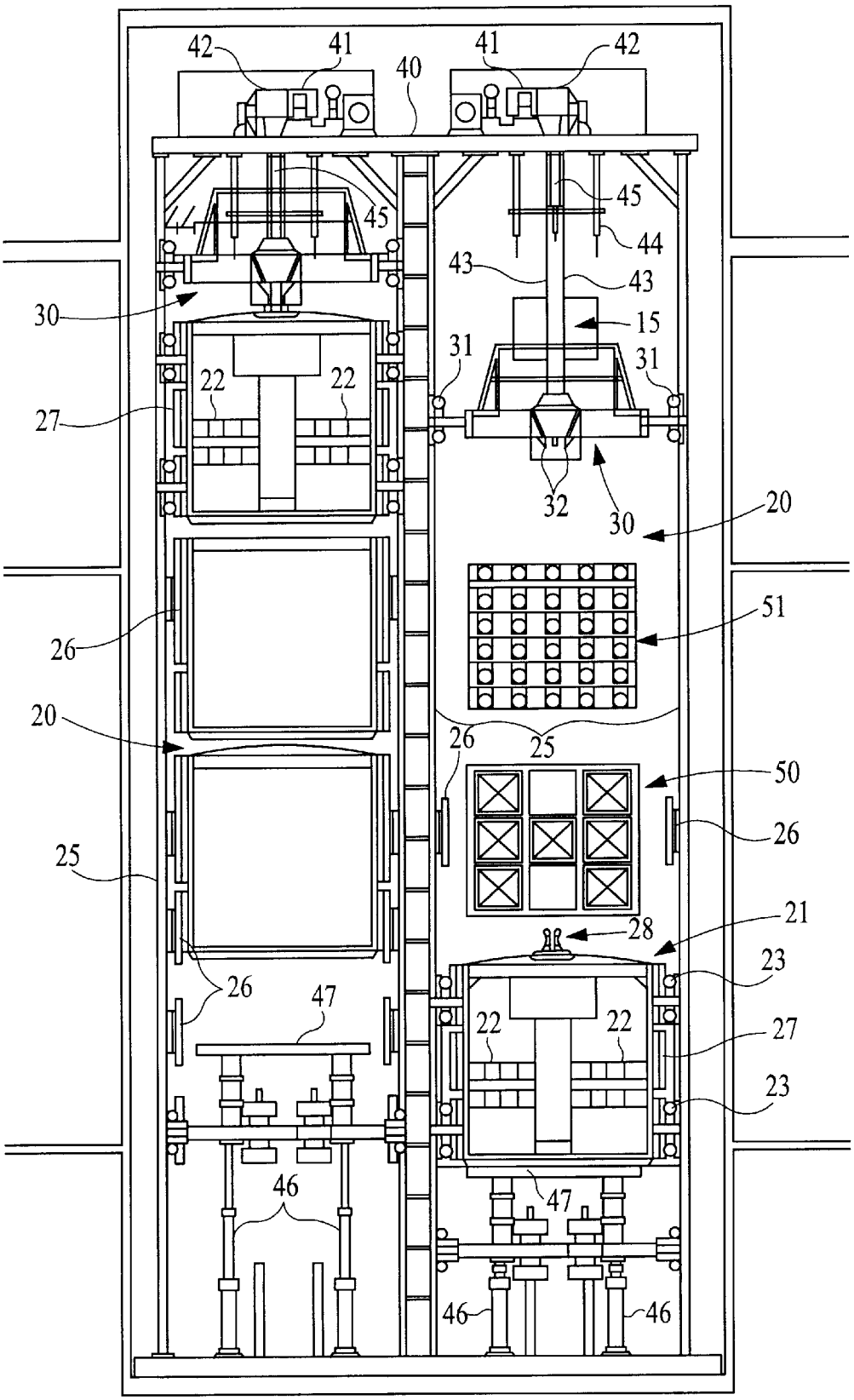
FIG. 4 is a sectional view showing an interior of the tower.

FIG. 3 is a plan view of the ground floor of the tower 11. The entrances 12, 12 lead to compartments 17, 17 through passages 16, 16, respectively. At the backs of the compartments 17, 17 are formed spaces long in the lengthwise direction of the tower 11 or vertical passages 20, 20 for ascent and descent separated from the compartments by doors 18, 18.

In each vertical passage 20 is disposed a cabin 21 for the players. The cabin 21 is shaped as a box having an entrance opening toward the front. In the cabin 21 , front and rear bench seats 22 are provided in two rows with the rear bench seat positioned higher.

On each of right and left inner walls of the vertical passage 20 are laid two guide rails 25 directed vertically. On the one hand, on each of right and left side walls of the cabin 21 are projected front and rear upper wheel units 23, 23 and front and rear lower wheel units 23, 23 and wheels of each wheel unit 23 are engaged with the guide rails 25 so as to roll pinching the guide rail and guide ascent and descent of the cabin 21 stably.

Between the front and rear guide rails 25, 25 on each of the right and left inner walls are provided a plurality of brake shoes 26 arranged in a vertical direction, and brake shoes provided on the right inner wall and those provided on the left inner wall are opposite to each other, respectively. When a pair of corresponding right and left brake shoes 26 approach each other and come into slide contact with right and left brake fins 27 of the cabin 21 respectively, the cabin 21 is put on the brake, and when the brake shoes are separated from the brake fins, the cabin is released from the brake.

On an upper wall surface of the cabin 21 is provided a hook device 28 having a pair of right and left hooks capable of opening and closing mutually.

A pulling-up rack 30 capable of ascending and descending freely is disposed above the cabin 21. The pulling-up rack 30 also has wheel units 31 and is guided up and down by wheels of the wheel units 31 engaging with the aforementioned guide rails 25 so as to roll.

At the highest part of the vertical passage 20 is provided a horizontal crosspiece 40 on which a motor 41 and a winch 42 driven by the motor are disposed. An end of a wire rope 43 to be wound up by the winch 42 is hung down and connected to the pulling-up rack 30. Therefore, when the winch 42 is driven by the motor 41 to wind up the wire rope 43, the pulling-up rack 30 goes up and when the winch 42 rewinds the rope 43, the rack 30 goes down.

Metal fittings 32 for receiving the hook device 28 of the cabin 21 is hung from the pulling-up rack 30. When the pulling-up rack 30 comes down to the cabin 21 which is stopped, the hook receiving metal fittings 32 automatically open a pair of hooks of the hook device 28 and engage with jaws of the hooks to lock for connection. After that, the cabin 21 can go up and down together with the pulling-up rack 30.

From the crosspiece 40 at the highest part of the vertical passage 20 are hung a positioning member 44 for positioning the pulling-up rack 30 at a highest point and a connection releasing cylinder 45. Therefore, the pulling-up rack 30 can be stopped at a predetermined highest position, and in this state, if the connection releasing cylinder 45 is driven, the hooks of the hook device 28 are closed to release lock between the hook device 28 and the hook receiving metal fittings 32 so that the cabin 21 can be dropped.

On a bottom of the vertical passage 20 are disposed air springs 46 supporting a rest 47. Normally, the cabin 21 is supported on the rest 47 and positioned at a predetermined lower position by the air springs 46, however, if a part of dropping energy should happen to remain in the cabin, the air springs 46 act as a damper to absorb the energy.

On an inner surface of the vertical passage 20 facing with the opening in front of the cabin 21 going up and down, are disposed five TV monitors 50 at a height corresponding to the second floor and lights 51 at a height corresponding to the third floor up and down in six lines and right and left in five rows. Further above them, the above-mentioned window 15 is provided at a height corresponding to the fourth floor.

The TV monitors 50 display various pictures for giving guidance to the players P in the cabin 21. The lights 51 are controlled so as to turn on and off in order in one direction, from top to bottom or from bottom to top.

Next, procedures of operation of the above-mentioned falling amusement ride 10 will be described.

Players P having entered the compartment 17 through the passage 16 from the entrance 12 go into the cabin 21 stopped at the predetermined lower position with the door 18 opened, changing places with players getting out of the cabin 21. Then, the player in the cabin 21 sits on the bench seat 22, lets down a safety bar capable of swinging provided in front of the bench seat 22 to the waist, and puts on a furnished head horn 52 which generates sound producing a stereophonic sound field to let the player hear sound for giving an effect or voice for guidance.

When the door 18 is closed, it becomes dark in the cabin and the player P can only listen to the sound or voice from the head horn. Meanwhile, the pulling-up rack 30 goes down and the hook device 28 and the hook receiving metal fittings 32 engage to be locked so that the cabin 21 is connected with the pulling-up rack 30. Then, the winch 42 winds up the wire rope 43 to lift the cabin 21 together with the pulling-up rack 30.

Figure 5:
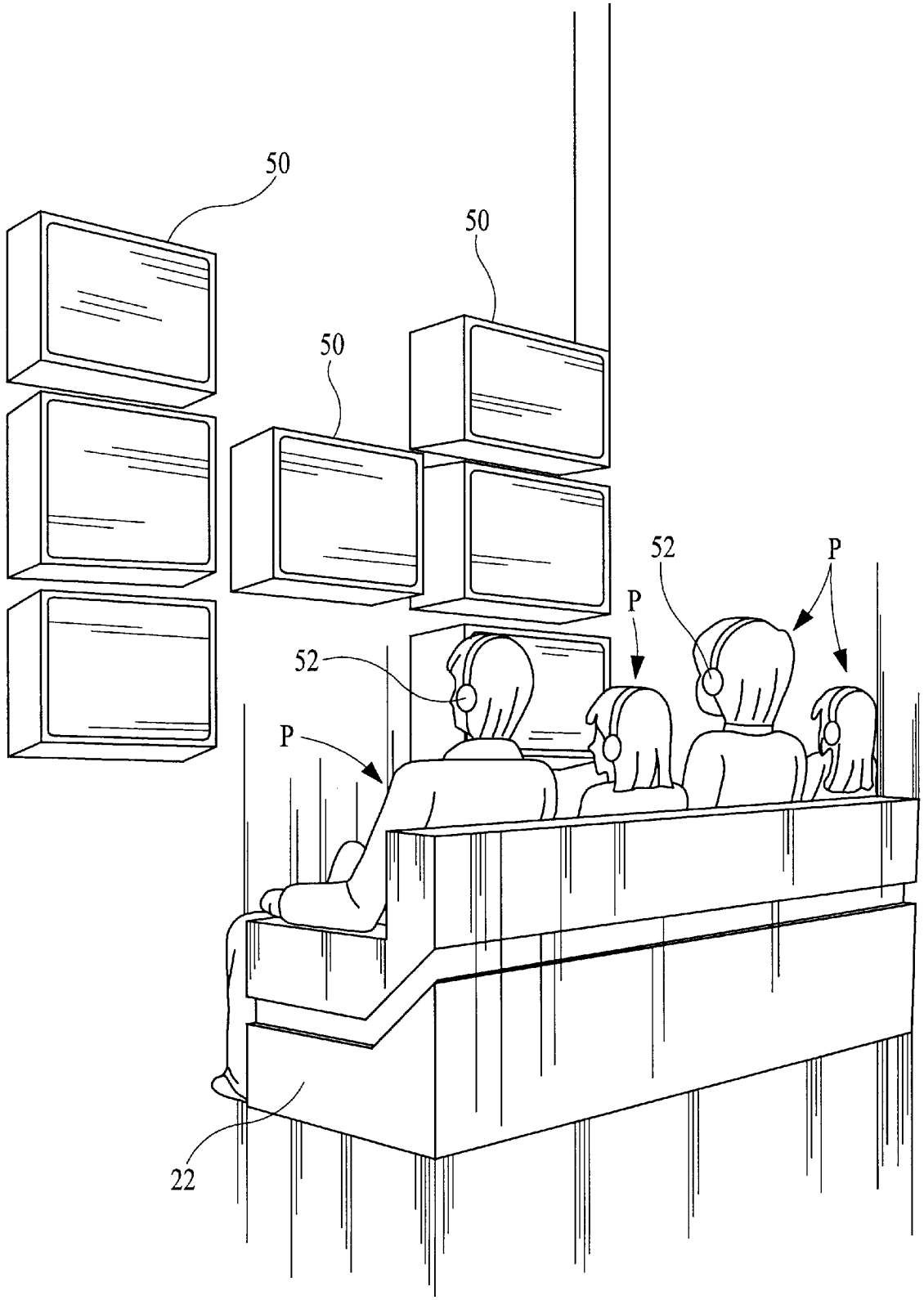
FIG. 5 is an illustration showing players in a cabin watching TV monitors in front.

The player P sees, at first, pictures of the TV monitors 50 as shown in FIG. 5, and a guidance regarding the falling amusement is carried out by the pictures and voices of the head horn 25.

Figure 6:
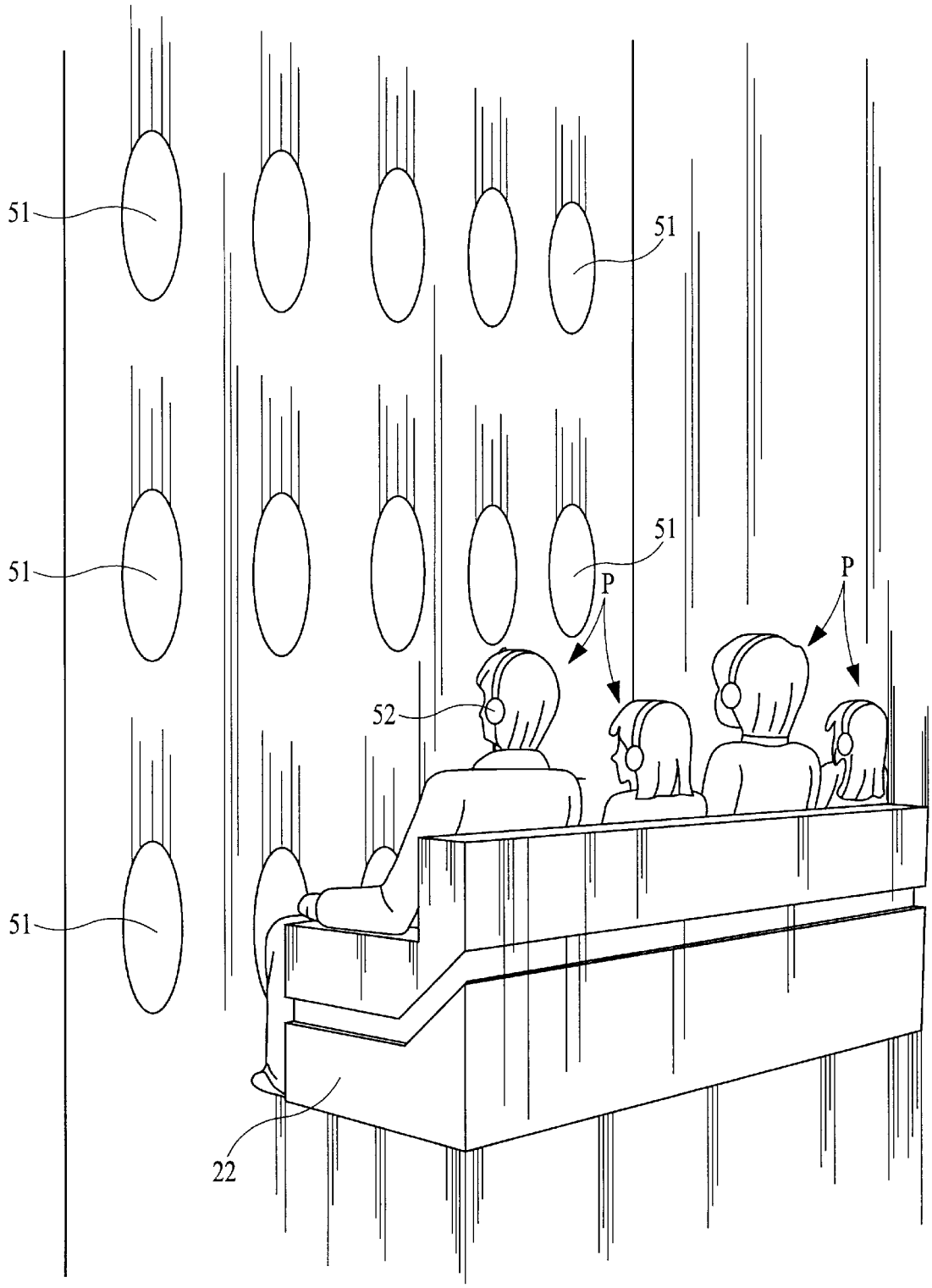
FIG. 6 is an illustration showing players in the cabin watching lights in front.

The cabin 21 goes up passing through the TV monitors 50 with an acceleration and the lights 51 turning on and off attract the player's attention (FIG. 6). Since the lights 51 turn on and off in order downward, the player P has an illusion that the lights are moving downward or he is going up himself at a high speed higher than the actual rising speed.

Figure 7:
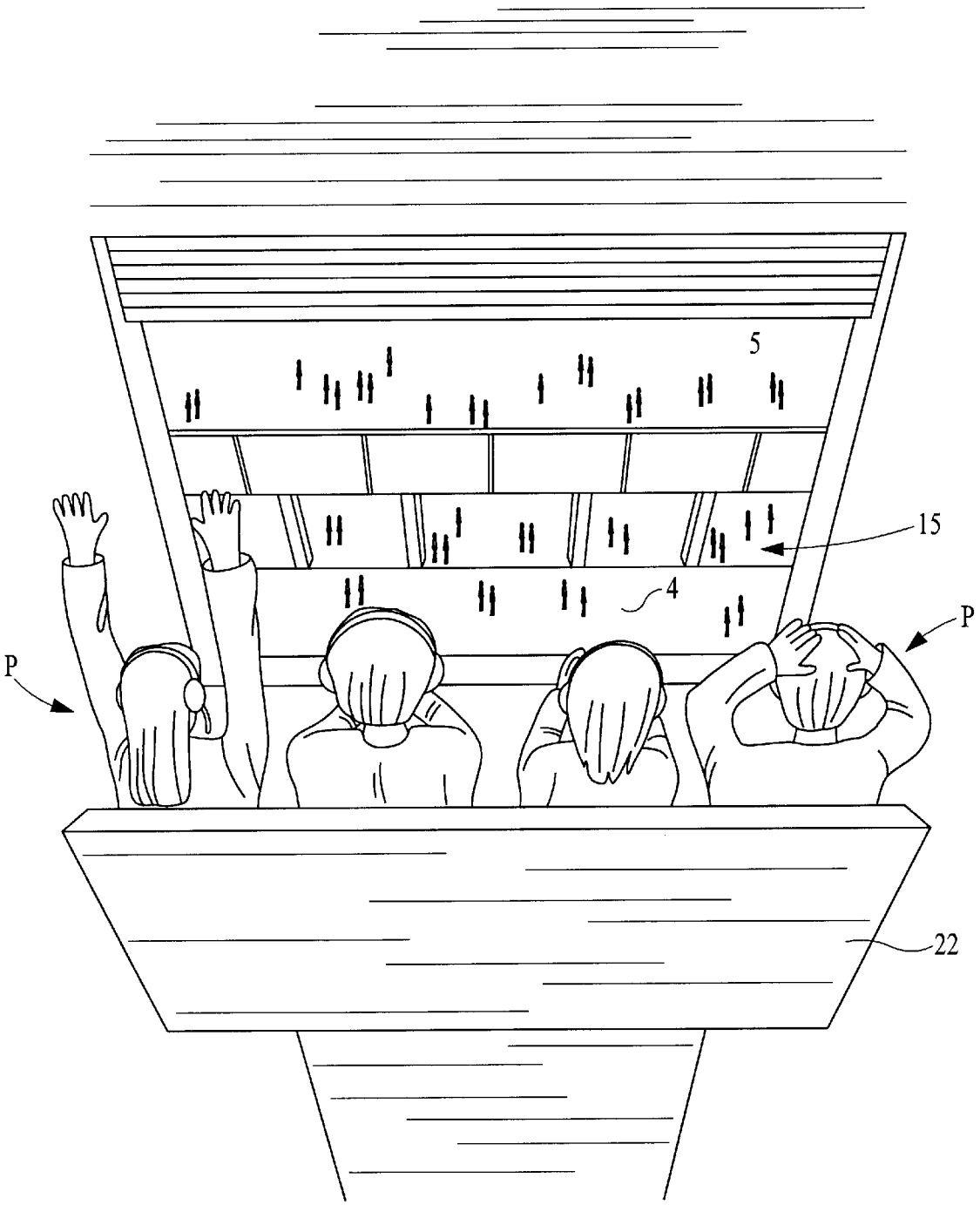
FIG. 7 is an illustration showing players in the cabin looking out of a window in front.

The cabin 21 is stopped once when it has passed through the lights 51, and the shutter 14 in front of the player P is opened to show the player the outside through the window 15 (FIG. 7). The window 15 restrains the field of vision of the player P so that he can see only the projecting porch-like portions of the third and second floors 5, 2 below, and he cannot see the first floor 2 or barely can see a part thereof. Therefore, the player has a illusion that the floors he is seeing are those of very high stories.

Since the illusion regarding height of the tower given before entrance, the sense of rising sensed in the dark and the illusion regarding rising speed given by the lights 51 have been accumulated and kept in memory of the player P already, the player has a very large illusion when he looks down the outside through the window and feels that he has gone up to a very high place higher than the actual place.

Then, the shutter 14 is closed and the winch 42 is rotated in reverse to let the cabin 21 drop once by about 3 m for inciting the player's fear ("faint dropping"). After that, the cabin 21 is lifted again and now the connection releasing cylinder 45 is driven to unlock the hook device 28 so that the cabin 21 is dropped freely.

Alternatively, the faint dropping may be carried out in such a manner that the cabin 21 is dropped freely by unlocking the hook device 28 by the connection releasing cylinder 45 and suitably stopped by the brake shoe 26. The faint dropping may be carried out several times.

When the cabin 21 passes through the lights 51 falling freely, the lights 51 is turned on and off in order from bottom to top. Therefore, the player has an illusion that the falling speed is higher than the actual speed and he feels more fearful so that he can enjoy very large thrill and excitement.

The cabin 21 is braked by the brake shoe 26 pinching the brake fin 27 and stopped being supported by the rest 47. Then the cabin 21 is somewhat lifted by action of the air spring 46 to the predetermined position, that is the initial starting height position, to complete the play.

As mentioned above, the falling amusement ride 10 gives the player P by various stage effects an illusion that he is lifted to a very high position, though the actual height is not so high. Therefore, the player can enjoy a thrill of the same extent as that in case he actually falls from a high position.

Since the falling amusement ride 10 is not so high as a conventional equipment, it can be constructed also indoors as in the present embodiment. Therefore, places for constructing the ride are limited little and it can be intended to increase the number of constructed rides.

Though the tower 11 is erected on the ground floor in the above-mentioned embodiment, the tower can be easily erected on a suitable floor above the ground floor, too.

The cabin 21 may be stopped at a position neighboring the lights 51 turning on and off in order downward. The player P in the cabin 21 is given an illusion that he is going up, by the lights turning on and off.

In place of the lights 51 provided for giving the illusion regarding the up and down speeds in the above-mentioned embodiment, moving bodies going up and down in front of the cabin may be provided so that the player in the cabin is given an illusion that he goes up and down with a speed faster than the actual speed by the bodies moving in the opposite direction to the cabin.

INDUSTRIAL APPLICABILITY

The present invention can be utilized for a falling amusement ride letting a player enjoy a thrill by lifting up and then dropping freely the player.

I claim:

1. A falling amusement ride in which a seat supported so as to go up and down is dropped, said amusement ride comprising:

illusion giving means for giving an illusion regarding a sense of height and speed of the seat to a player sitting on the seat, wherein the player feels that the seat is at a higher position than an actual position of the seat due to the illusion regarding the sense of height and the player feels that the seat is moving at a speed faster than an actual speed of the seat due to the illusion regarding the sense of speed; and said illusion giving means comprises a moving body capable of moving up and down in front of said seat going up and down, and driving control means for moving said body in an up and down direction.

2. A falling amusement ride as claimed in claim 1, wherein said driving control means moves said moving body concurrently with and in the opposite direction to said seat going up and down.

3. A falling amusement ride as claimed in claim 1, wherein said illusion giving means comprises side walls isolating a space which said seat goes up and down within from an outside, and a window formed in one of said side walls in front of said seat at a position of predetermined height, said window being constituted so as to limit sight of the player sitting on said seat to hide a part of lower outside from the player.

4. A falling amusement ride in which a seat supported so as to go up and down is dropped, comprising:

illusion giving means for giving an illusion regarding a sense of height to a player sitting on the seat, said illusion giving means comprises a moving body capable of moving up and down in front of said seat going up and down, and driving control means for moving said body in an up and down direction; and a tower, said tower forming a space in which said seat goes up and down within, said tower being erected in a building, wherein a top of said tower is hidden by a ceiling of said building.

5. A falling amusement ride as claimed in claim 4, wherein said illusion giving means also gives an illusion regarding a sense of speed of the seat to a player sitting on the seat, wherein the player feels that the seat is moving at a speed faster than an actual speed of the seat due to the illusion regarding the sense of speed.

6. A falling amusement ride as claimed in claim 4, wherein said driving control means moves said moving body concurrently with and in the opposite direction to said seat going up and down.

7. A falling amusement ride as claimed in claim 4, wherein said illusion giving means comprises side walls, said side walls isolating a space in which said seat goes up and down within from an outside, and a window formed in one of said side walls in front of said seat at a position of predetermined height, said window being constituted so as to limit sight of the player sitting on said seat to hide a portion of the outside from the player.

8. A falling amusement ride in which a seat supported so as to go up and down is dropped, said amusement ride comprising:

illusion giving means for giving an illusion regarding a sense of height and speed of the seat to a player sitting on the seat, wherein the seat is at a higher position than an actual position of the seat due to the illusion regarding the sense of height and the player feels that the seat is moving at a speed faster than an actual speed of the seat due to the illusion regarding the sense of speed; said illusion giving means comprises:

a number of lighting devices arranged in a vertical direction in front of said seat going up and down; and control means for turning said lighting devices on and off in order and in one direction.

9. The falling amusement ride of claim 8, wherein said control means turns said lighting devices on and off in order concurrently with and in an opposite direction to said seat going up and down.

* * * * *